US008953964B2

(12) United States Patent
Jeong et al.

(10) Patent No.: US 8,953,964 B2
(45) Date of Patent: Feb. 10, 2015

(54) IMAGE FORMING APPARATUS AND METHOD OF CONTROLLING FUSING TEMPERATURE OF THE SAME

(75) Inventors: An-sik Jeong, Hwaseong-si (KR); Yong-geun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 22 days.

(21) Appl. No.: 13/617,735

(22) Filed: Sep. 14, 2012

(65) Prior Publication Data

US 2013/0142535 A1 Jun. 6, 2013

(30) Foreign Application Priority Data

Dec. 1, 2011 (KR) ..... 10-2011-0127856

(51) Int. Cl.
*G03G 15/20* (2006.01)

(52) U.S. Cl.
USPC ..... 399/69; 399/70

(58) Field of Classification Search
USPC ..... 399/69–70, 330; 219/216
See application file for complete search history.

(56) References Cited

U.S. PATENT DOCUMENTS 4,937,600 A * 6/1990 Hirabayashi et al. ..... 347/156
5,481,089 A * 1/1996 Furuta ..... 219/497
5,839,023 A * 11/1998 Morigami ..... 399/69
6,122,479 A * 9/2000 Fujita et al. ..... 399/333
6,301,454 B1 * 10/2001 Nishida et al. ..... 399/69
7,679,354 B2 * 3/2010 Shin ..... 323/325
8,180,241 B2 * 5/2012 Chae et al. ..... 399/70
8,270,862 B2 * 9/2012 Hwang et al. ..... 399/69
2006/0157464 A1 * 7/2006 Omata et al. ..... 219/216
2007/0036570 A1 * 2/2007 Tatematsu et al. ..... 399/69
2008/0069584 A1 * 3/2008 Sanada et al. ..... 399/88
2009/0139982 A1 * 6/2009 Cao et al. ..... 219/492
2010/0178072 A1 * 7/2010 Hwang et al. ..... 399/69
2010/0247131 A1 * 9/2010 Sato et al. ..... 399/70
2010/0247180 A1 * 9/2010 Konishi et al. ..... 399/328
2011/0044736 A1 * 2/2011 Konishi et al. ..... 399/328
2011/0142475 A1 * 6/2011 Kim ..... 399/69
2012/0168429 A1 * 7/2012 Kim et al. ..... 219/548
2012/0234820 A1 * 9/2012 Kim et al. ..... 219/216

FOREIGN PATENT DOCUMENTS

JP 2003-215963 7/2003
JP 2006-292994 10/2006

* cited by examiner

*Primary Examiner* — G. M. Hyder
(74) *Attorney, Agent, or Firm* — Staas & Halsey LLP

(57) ABSTRACT

An image forming apparatus having two or more different rated voltages, the image forming apparatus including a voltage detecting unit, which detects a voltage level of alternating current (AC) power supplied from outside of the image forming apparatus; a control unit, which outputs a control signal according to the detected voltage level; a fusion driving circuit, which controls a number of waveforms and phase of the AC power according to the control signal and outputs the controlled AC power as fusing power; and a fuser including a heat generating body having a negative temperature coefficient (NTC) characteristic, which receives the fusing power and generates resistance heat; and a heating member, which is heated by the heat generated by the resistance heat generating body and fuses an image formed on a printing medium.

24 Claims, 10 Drawing Sheets

IMAGE FORMING APPARATUS AND METHOD OF CONTROLLING FUSING TEMPERATURE OF THE SAME

CROSS-REFERENCE TO RELATED APPLICATIONS

This application claims priority under 35 U.S.C. §119 from Korean Patent Application No. 10-2011-0127856, filed on Dec. 1, 2011, in the Korean Intellectual Property Office, the disclosure of which is incorporated herein in its entirety by reference.

BACKGROUND OF THE INVENTION

1. Field of the Invention

The present general inventive concept relates to an image forming apparatus including a fuser having two or more different rated voltages and a method of controlling a fusing temperature of the same.

2. Description of the Related Art

An image forming apparatus forms an image according to processes as described below. First, an electrostatic latent image is formed by exposing a photosensitive body, and the electrostatic latent image is developed by supplying toner thereto. In other words, toner particles charged on a surface of the photosensitive body are distributed according to a shape of the electrostatic latent image. Next, the image formed on the photosensitive body is transferred onto a printing medium. In other words, toner particles on the surface of the photosensitive body are transferred onto the printing medium. Finally, a toner image formed on the printing medium is fused to the printing medium by heating and pressing the toner image. Then, the image forming processes are completed.

Among the image forming processes, the process of fusing a toner image formed on a printing medium will be described below in detail. The printing medium on which the toner image is formed is carried into a fuser consisting of a heating roller and a pressing roller and fusion is performed thereon. The heating roller may include a heat generating body and may be heated by heat generated by the heat generating body, whereas the pressing roller forms a fusing nip with the heating roller by contacting at a certain point. The printing medium is heated and pressed by the heating roller and the pressing roller as the printing medium passes through the fusing nip of the fuser, and thus the toner image is fused. The heat generating body is supplied with power and generates resistance heat and may generally include a halogen lamp, for example.

Recently, image forming apparatuses having two or more different rated voltages are widely manufactured. To embody an image forming apparatus having two or more different rated voltages (hereinafter, referred to as a "free voltage image forming apparatus"), a fuser included therein should also be a fuser having two or more different rated voltages (hereinafter, referred to as a "free voltage fuser"). However, a heat generating body included in a fuser has a resistance value set to receive a desired level of power with respect to an input voltage. Therefore, to embody a free voltage fuser, the free voltage fuser may include a plurality of heat generating bodies having their own resistance values respectively corresponding to rated voltages. Alternatively, the free voltage fuser may include a single heat generating body and desired powers may be acquired by controlling a supply of fusing power.

In a case where a fuser includes a plurality of heat generating bodies having resistance values respectively corresponding to rated voltages, there are problems including increased manufacturing costs, an increased size, an increased weight, etc. In a case where a fuser includes a single heat generating body and free voltage is embodied by controlling fusing power supplied to the fuser, an inrush current and a flicker may occur during application of a relatively high rated voltage from among a plurality of rated voltages of an image forming apparatus. The main reason that the inrush current and the flicker occur is related to a positive temperature coefficient (PTC) characteristic of a halogen lamp used as a heat generating body of a fuser. Due to the PTC characteristic, a halogen lamp has a low resistance at low temperatures, and a resistance of the halogen lamp increases as the temperature increases. Therefore, when a halogen lamp is initially driven, fusing power is input when the resistance of the halogen lamp is low, and thus the inrush current and the flicker occur.

SUMMARY OF THE INVENTION

The present general inventive concept provides an image forming apparatus including a fuser having two or more different rated voltages and a method of controlling a fusing temperature thereof.

Additional features and utilities of the present general inventive concept will be set forth in part in the description which follows and, in part, will be obvious from the description, or may be learned by practice of the general inventive concept.

According to features and utilities of the present general inventive concept, there is provided an image forming apparatus having two or more different rated voltages, the image forming apparatus including a voltage detecting unit, which detects a voltage level of alternating current (AC) power supplied from outside of the image forming apparatus; a control unit, which outputs a control signal according to the detected voltage level; a fusion driving circuit, which controls a number of waveforms and a phase of the AC power according to the control signal and outputs the controlled AC power as fusing power, and a fuser including a heat generating body having a negative temperature coefficient (NTC) characteristic, which receives the fusing power and generates resistance heat, and a heating member, which is heated by the resistance heat generated by the heat generating body and fuses an image formed on a printing medium.

The image forming apparatus further includes a temperature measuring unit, which measures a temperature of the heating member, wherein the control unit outputs the control signal, such that the temperature of the heating member measured by the temperature measuring unit reaches a target temperature to perform the fusing.

The control unit outputs the control signal, such that the fusion driving circuit controls the number of waveforms of the AC power and outputs the controlled AC power as the fusing power during a warm-up interval until the temperature of the heating member reaches the target temperature before the fusing is performed and controls the phase of the AC power and outputs the controlled AC power as the fusing power during a fusing performing interval after the temperature of the heating member has reached the target temperature.

The control unit outputs the control signal, such that the fusion driving circuit controls the number of waveforms of the AC power and outputs the controlled AC power as the fusing power during a warm-up interval until the temperature of the heating member reaches a predetermined temperature below the target temperature before the fusing is performed and controls the phase of the AC power and outputs the controlled AC power as the fusing power during a fusing performing interval after the temperature of the heating member has reached the predetermined temperature below the target temperature.

The control unit outputs the control signal, such that the fusion driving circuit controls the phase of the AC power by changing a firing angle according to the detected voltage level and outputs the controlled AC power as the fusing power.

The heat generating body is a carbon heat generating body or a carbon nanotube heat generating body.

The voltage detecting unit includes a potential transformer or a photo coupler.

The voltage detecting unit detects the voltage level of the AC power based on a temperature change of the heating member during the warm-up interval until the temperature of the heating member reaches the target temperature to perform fusion.

According to other features and utilities of the present general inventive concept, there is provided a method of controlling a fusing temperature of an image forming apparatus having two or more different rated voltages, the image forming apparatus including a fuser including a heat generating body having a negative temperature coefficient (NTC) characteristic, which receives the fusing power and generates resistance heat, and a heating member, which is heated by the heat generated by the heat generating body and fuses an image formed on a printing medium, the method including detecting a voltage level of alternating current (AC) power supplied from outside, controlling the number of waveforms and phase of the AC power according to the detected voltage level, such that the heating member maintains a target temperature to perform the fusing and supplying the controlled AC power to the heat generating body as fusing power.

The controlling and supplying of the AC power includes controlling the number of waveforms of the AC power and supplying the controlled AC power to the heat generating body as the fusing power during a warm-up interval until the temperature of the heating member reaches the target temperature before the fusing is performed, and controlling the phase of the AC power and outputting the controlled AC power as the fusing power during a fusing performing interval after the temperature of the heating member has reached the target temperature.

The controlling and supplying of the AC power includes controlling the number of waveforms of the AC power and supplying the controlled AC power to the heat generating body as the fusing power during a warm-up interval until the temperature of the heating member reaches a predetermined temperature below the target temperature before the fusing is performed, and controlling the phase of the AC power and outputting the controlled AC power as the fusing power during a fusing performing interval after the temperature of the heating member has reached the predetermined temperature below the target temperature.

In the controlling and supplying of the AC power, the phase of the AC power is controlled by changing a firing angle according to the voltage level of the AC power and the controlled AC power is supplied to the heat generating body as the fusing power In the detecting of the voltage level of the AC power, the voltage level of the AC power is detected based on a temperature change of the heating member during a warm-up interval until the temperature of the heating member reaches the target temperature to perform fusing.

According to other features and utilities of the present general inventive concept, there is provided an image forming apparatus including a control unit to output a control signal according to a detected voltage level of alternating current (AC) power; a fusion driving circuit to adjust the AC power according to the control signal and to output the adjusted AC power as fusing power; and a fuser, where the fuser includes a heat generating body having a negative temperature coefficient (NTC) characteristic, the heat generating body to receive the fusing power to generate resistance heat; and a heating member that is heated by the resistance heat to fuse an image formed on a printing medium.

The fusion driving circuit adjusts the AC power by controlling a number of waveforms and a phase of the AC power according to the control signal.

The control unit outputs the control signal according to a temperature of the heating member.

The control unit outputs the control signal for the adjusted AC power to heat the heating member until the temperature of the heating member reaches a target temperature to perform fusing.

The control unit outputs a first control signal to heat the heating member until the temperature of the heating member reaches a middle temperature below a target temperature to perform fusing, and then outputs a second control signal to heat the heating member until the temperature of the heating member reaches the target temperature to perform fusing.

The control unit outputs the control signal to stop heating the heating member if the control unit determines that the temperature of the heating member has reached the target temperature to perform fusing.

The image forming apparatus further includes a voltage detecting unit to detect the voltage level of the AC power to provide the detected voltage level to the control unit.

The voltage detecting unit detects the voltage level of the AC power based on a temperature change of the heating member until the temperature of the heating member. reaches a target temperature to perform fusion The voltage level of the AC power is obtained by using a look-up table that includes voltage levels corresponding to respective temperature changes.

The image forming apparatus further includes a temperature measuring unit to measure a temperature of the heating member, wherein the control signal output by the control unit is based on the measured temperature of the heating member.

The control unit outputs the control signal based on a firing angle according to the detected voltage level to control the phase of the AC power according to the control signal.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE PREFERRED EMBODIMENTS

Figure 1:
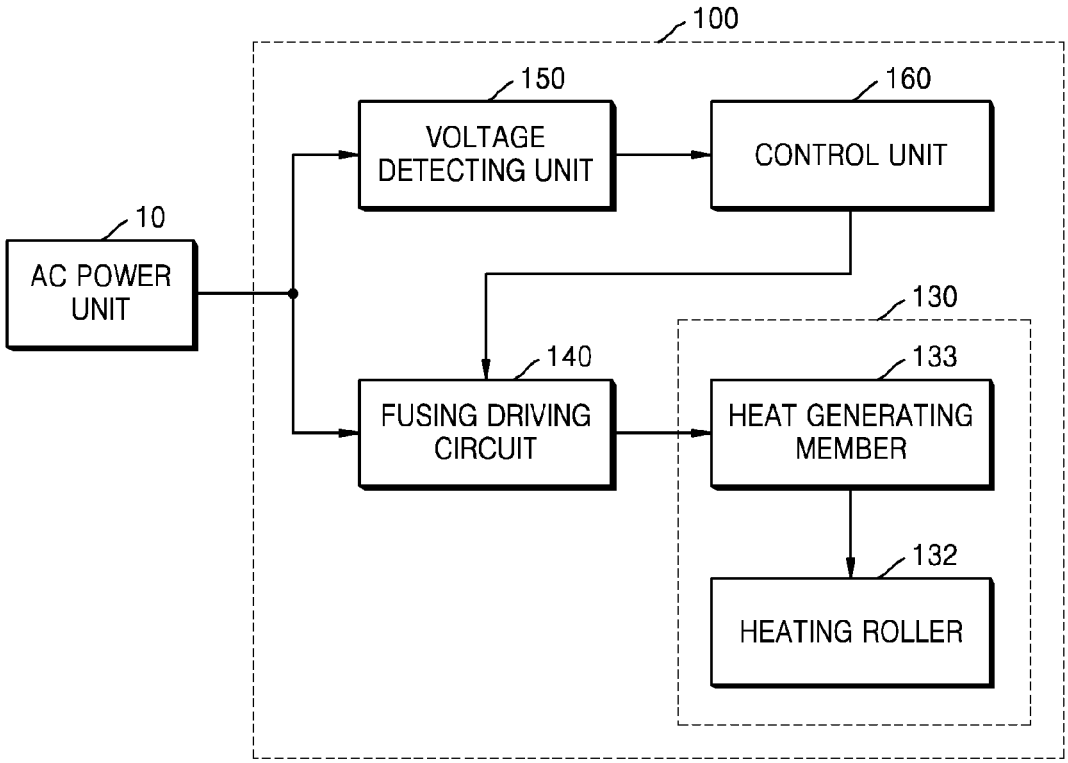
FIG. 1 is a block diagram illustrating an image forming apparatus according to an embodiment of the present general inventive concept.

The present general inventive concept will now be described more fully with reference to the accompanying drawings, in which exemplary embodiments of the present general inventive concept are shown. In the description of the present general inventive concept, certain detailed explanations of related art are omitted when it is deemed that they may unnecessarily obscure the essence of the invention.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
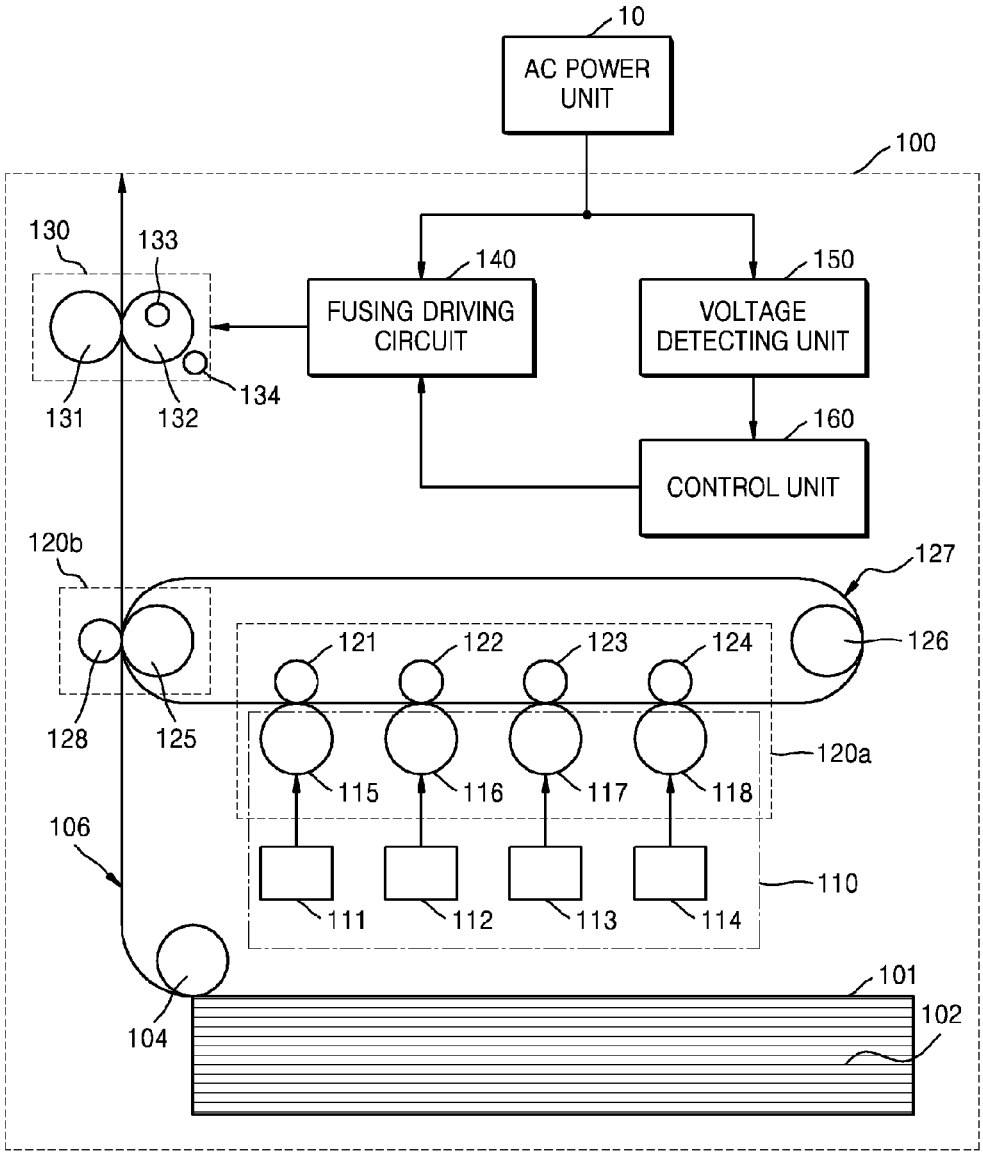
FIG. 2 is a diagram illustrating a detailed configuration of the image forming apparatus according to the exemplary embodiments of the present general inventive concept.

FIG. 1 is a block diagram illustrating an image forming apparatus according to an embodiment of the present general inventive concept, and FIG. 2 is a diagram illustrating a detailed configuration of the image forming apparatus according to the exemplary embodiments of the present general inventive concept. FIG. 1 shows components for fusion, whereas FIG. 2 additionally shows components that are commonly included in an image forming apparatus, such as a development unit 110 and a transfer unit 120.

Referring to FIGS. 1 and 2, an image forming apparatus 100 according to an embodiment of the present general inventive concept may include the development unit 110, the transfer unit 120, a fusion unit 130, a fusion driving circuit 140, a voltage detecting unit 150, and a control unit 160. Furthermore, the fusion unit 130 may include a heat generating member 133 having negative temperature coefficient (NTC) characteristics and a heating roller 132. An NTC characteristic refers to a characteristic whereby a resistance decreases as a temperature increases. Thus, for example, the heat generating member 133 may include a heat generating body having the NTC characteristics, and the resistance of the heat generating body having NTC characteristics may decrease as the temperature of the heat generating body increases. The heat generating body having NTC characteristics may be a carbon heat generating body or a carbon nanotube heat generating body, for example.

A detailed description of image forming processes of an image forming apparatus according to an embodiment of the present general inventive concept will be given below. When an image forming apparatus receives image data from outside, the development unit 110 develops an image. In more detail, when light exposing units 111 through 114 scan light onto photosensitive bodies 115 through 118, respectively, electrostatic latent images are formed at the photosensitive bodies 115 through 118, and, when a developer including toner is supplied thereto, developer particles are charged and attached to surfaces of the photosensitive bodies 115 through 118 and toner images are formed. FIG. 2 illustrates the four light exposing units 111 through 114 and the four photosensitive bodies 115 through 118, because an image forming apparatus for forming color images generally includes a photosensitive body and an exposing unit for each of four colors CMYK, that is, cyan (C), magenta (M), yellow (Y), and black (K). Thus, for example, the four photosensitive bodies 115, 116, 117, and 118 may be for C, M, Y, and K, respectively. However, the present general inventive concept is not limited thereto. Further, the image forming apparatus 100 also includes a printing medium storage unit 101 to store printing medium 102 such as paper, and a printing medium feeding roller 104 to feed the printing medium 102 to a printing medium transporting path 106.

The toner images formed at the photosensitive bodies 115 through 118 are transferred to an intermediate transfer belt 127 by the first transfer unit 120*a* including first transfer rollers 121 through 124 respectively corresponding with the photosensitive bodies 115 through 118. Thus, for example, toner images regarding each of cyan, magenta, yellow, and black may be transferred to the intermediate transfer belt 127 that is circulated by the intermediate transfer rollers 125 and 126, and thus a color image may be formed. Next, the color image formed on the intermediate transfer belt 127 is transferred to a printing medium 102 at a second transfer unit 120*b* including a second transfer roller 128 corresponding with the intermediate transfer roller 125. FIGS. 1 and 2 illustrate an embodiment in which images are first transferred from the photosensitive bodies 115 through 118 to the intermediate transfer belt 127 to form a color image on the intermediate transfer belt 127, and the color image formed on the intermediate transfer belt 127 is secondly transferred from the intermediate transfer belt 127 to the printing medium 102. However, in another embodiment, images may also be directly transferred from photosensitive bodies to a printing medium. Furthermore, the intermediate transfer belt 127 and the printing medium 102 to which images are transferred may be referred to as transfer media.

The printing medium 102 to which the color image is transferred is transferred to the fusion unit 130 via a printing medium transporting path 106 and is heated, and is then pressed by pressing roller 131 and heating roller 132. The fusion unit 130 includes the heat generating member 133 having an NTC characteristic and the heating roller 132 is heated by the heat generating member 133 receiving fusing power. In one embodiment, the heating roller 132 may include the heat generating member 133, and in another embodiment, the heating roller 132 may be spaced apart from the heat generating member 133. The pressing roller 131 forms a fusing nip with the heating roller 132 by contacting the heating roller 132 at a certain point. The heat generating member 133 receives fusing power from the fusion driving circuit 140, generates resistance heat, and heats the heating roller 132. Since a halogen lamp, which is generally used as a heat generating body in the related art, has a positive temperature coefficient (PTC) characteristic, the halogen lamp has a low resistance due to a low temperature when fusing power is initially supplied from the fusion driving circuit 140, and thus an inrush current and a flicker occur when the fusing power is initially supplied to the halogen lamp. However, the heat generating member 133, which has the NTC characteristic and is included in the image forming apparatus according to the exemplary embodiments of the present general inventive concept, has a high resistance due to a low temperature when fusing power is initially supplied, and thus the inrush current and the flicker may be suppressed.

Meanwhile, the image forming apparatus according to the exemplary embodiments of the present general inventive concept is an image forming apparatus having two or more different rated voltages (hereinafter, referred to as a "free voltage image forming apparatus"), in which the voltage detecting unit 150 detects a voltage level of alternating current (AC)

power supplied from an external AC power unit 10 and the control unit 160 controls supply of fusing power to the fusing unit 130 by applying a control signal to the fusing driving circuit 140 according to the voltage level detected by the voltage detecting unit 150, such that the temperature of the heating roller 132 of the fusion unit 130 becomes the target temperature required for performing fusion. The temperature of the heating roller 132 may be measured by a temperature measuring unit 134.

If only one heat generating body having a PTC characteristic is included and a free voltage image forming apparatus is embodied by controlling supply of fusing power, an inrush current and a flicker may occur during application of a relatively high rated voltage from among a plurality of rated voltages that can be provided by the image forming apparatus. Therefore, if the heat generating body having the PTC characteristic is used, in order to embody a free voltage image forming apparatus, it is necessary to prepare a plurality of heat generating bodies having different resistances and to supply power to one selected from among the plurality of heat generating bodies according to a voltage level of AC power supplied from outside. In this case, it is necessary for the image forming apparatus to include the plurality of heat generating bodies, and thus there are problems including increased manufacturing costs, an increased size, an increased weight, and etc.

However, since the image forming apparatus 100 according to the exemplary embodiments of the present general inventive concept includes the heat generating member 133 having the NTC characteristic, the inrush current and the flicker may be effectively suppressed when fusing power is initially supplied, and thus the image forming apparatus may include only one heat generating body, and free voltage may be embodied only by controlling fusing power supplied to the heat generating body. In more detail, the fusing power is controlled by adjusting a duty ratio of the AC power supplied from outside according to the voltage level of the AC power and outputting the controlled AC power as fusing power. A phase of the AC power is controlled to decrease the duty ratio if the voltage level of the AC power is high, or the phase of the AC power is controlled to increase the duty ratio if the voltage level of the AC power is low. Then, the AC power with the controlled phase is output as the fusing power. A method of controlling the fusing power supplied to the fusion unit 130 will be described below in detail.

Figure 3:
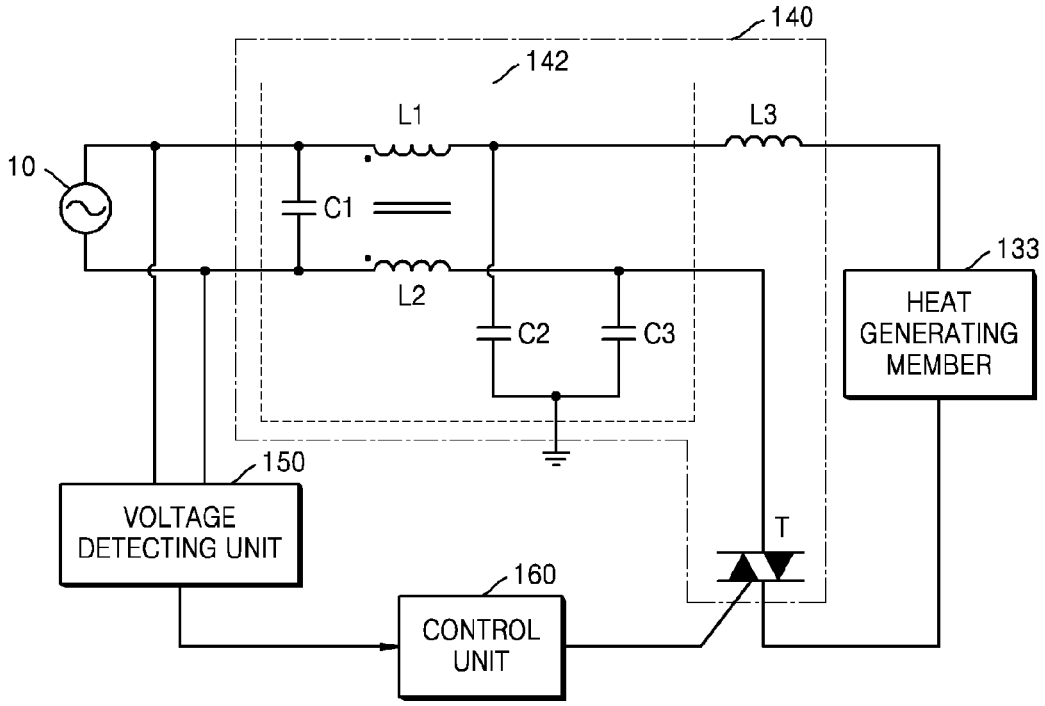
FIG. 3 is a detailed circuit diagram illustrating a fusion driving circuit of FIG. 1.

FIG. 3 is a detailed circuit diagram illustrating the fusion driving circuit 140 of FIG. 1. Referring to FIG. 3, the voltage detecting unit 150 detects a voltage level of the AC power supplied by the external AC power unit 10, and the control unit 160 adjusts a duty ratio of the AC power supplied by the AC power unit 10 by applying a control signal according to the detected voltage level to a triac T of the fusion driving circuit 140. Therefore, the AC power supplied by the AC power unit 10 may be adjusted based on the control signal and supplied as the fusing power to the heat generating member 133 having an NTC characteristic. The control unit 160 performs pulse width modulation (PWM) according to the voltage level of the AC power supplied by the AC power unit 10 and outputs a control signal, such that the heating roller 132 of the fusion unit 130 maintains a target temperature required for fusion. Detailed descriptions of the control unit 160 to perform the PWM and to output the control signal will be given below with reference to FIGS. 4 and 5.

Furthermore, the fusion driving circuit 140 may include an electromagnetic interference (EMI) filter 142 for blocking EMI noise as well as performing phase control and may include a choke coil L3 for reducing harmonics during phase control. A first coil L1 and a second coil L2 of the EMI filter 142 constitute a common mode filter for noise removal. The EMI filter 142 may also include a first capacitor C1 connected to a first end of the first coil 1 and a first end of the second coil L2, a second capacitor connected to the second end of the first coil L1, and a third capacitor connected to the second end of the second coil L2. The second capacitor C1 and the third capacitor C3 are grounded. Further, the second end of the first coil L1 is connected to the choke coil L3, and the second end of the second coil L2 is connected to the triac T.

Furthermore, although not shown, the voltage detecting unit 150 may further include a potential transformer or a photo coupler for detecting the voltage level of the AC power supplied by the AC power unit 10.

Figure 4:
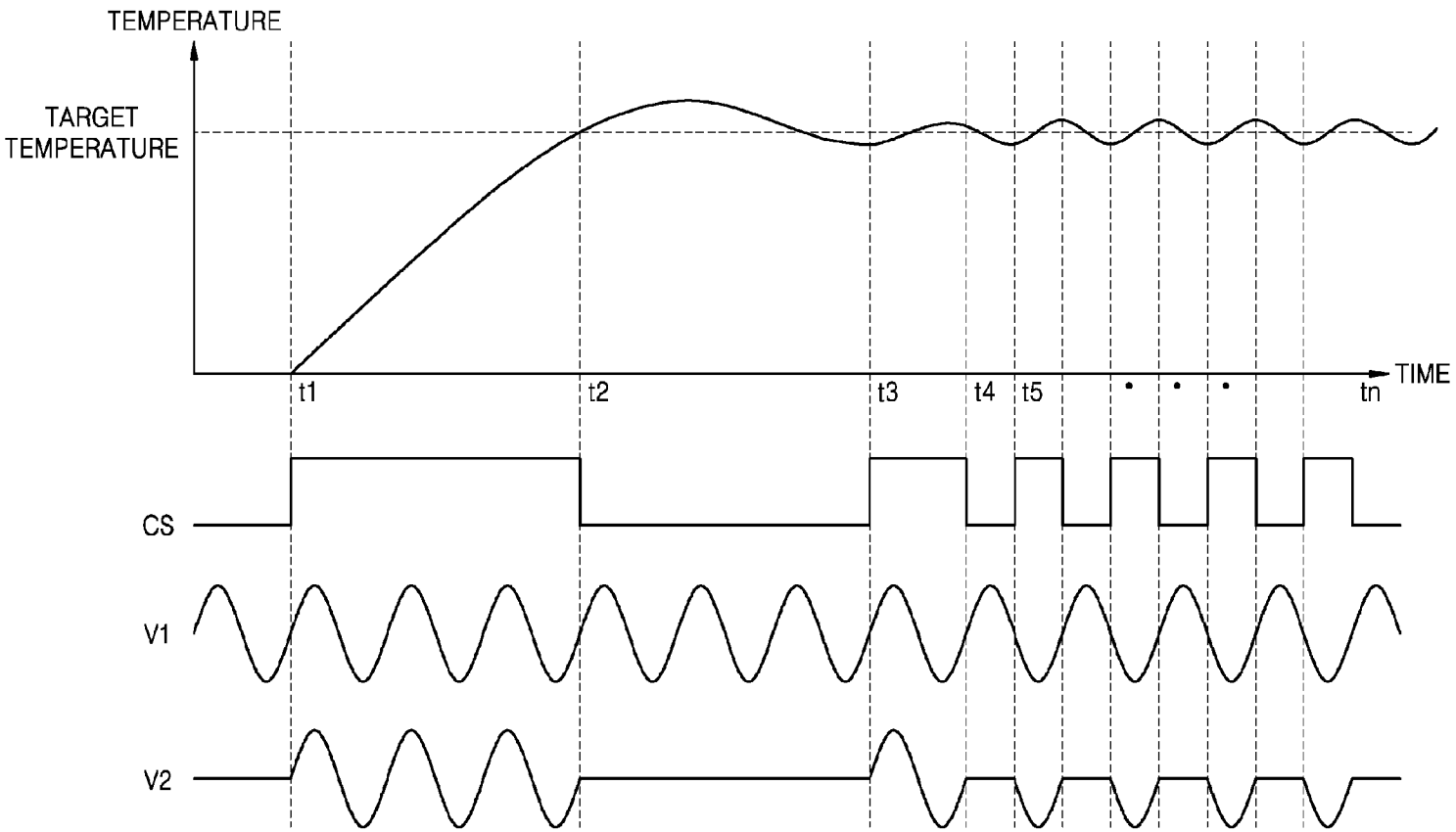
FIGS. 4 and 5 are graphs for illustrating a method of controlling a fusing temperature of the image forming apparatus according to an embodiment of the present general inventive concept.
Figure 5:
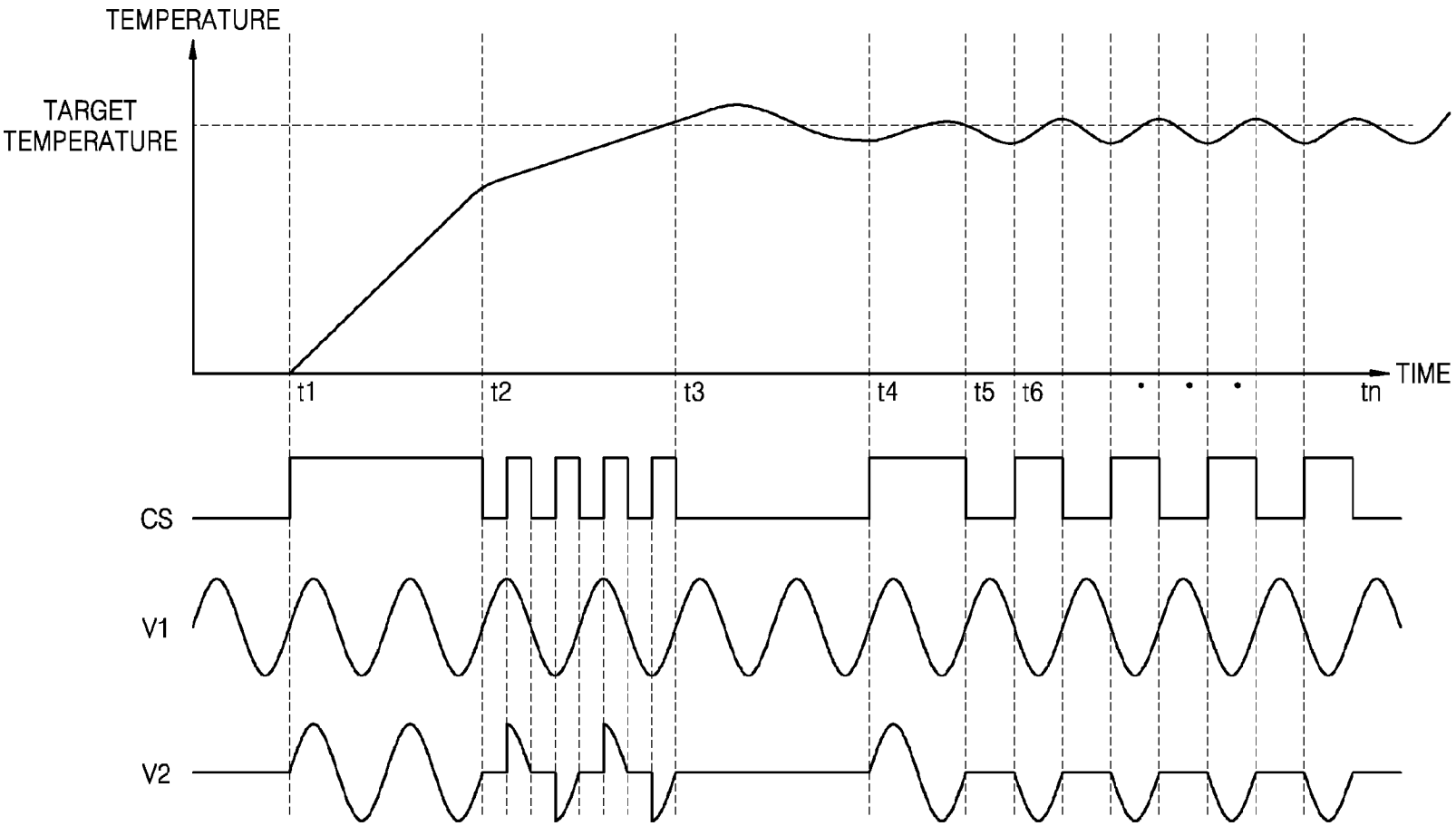

FIGS. 4 and 5 are graphs for illustrating a method of controlling a fusing temperature of the image forming apparatus according to an embodiment of the present general inventive concept. FIGS. 4 and 5 show graphs of a temperature of the heating roller 132 of the fusion unit 130 with respect to time, where CS indicates a control signal applied by the control unit 160 to the fusion driving circuit 140, and V1 and V2 respectively indicate AC voltage supplied by the external AC power unit 10 and fusing voltage supplied by the fusion driving circuit 140 to the heat generating member 133 of the fusion unit 130. Referring to FIG. 4, the temperature of the heating roller 132 starts to rise from a point of time t1 and reaches the target temperature required for performing fusion at a point of time t2. The interval from the point of time t1 to the point of time t2 is referred to as a warm-up interval. During the warm-up interval, the number of waveforms of the AC voltage V1 is controlled and the controlled AC voltage V1 is supplied as the fusing voltage V2. In controlling the number of waveforms, a number of waveforms of the AC voltage V1 to be supplied as the fusing voltage V2 is determined. In other words, considering a sine wave for one cycle as a single waveform, the number of waveforms of the AC power V1 to be supplied as the fusing power V2 is determined. For example, referring to FIG. 4, three waveforms of the AC power V1 are supplied as the fusing power V2 in the interval from the point of time t1 to the point of time t2. The controlling of the number of waveforms includes determining the number of waveforms of the AC voltage V1 to be supplied as the fusing voltage V2 based on a current temperature of the heating roller 132 and the voltage level of the AC power V1, such that the heating roller 132 reaches the target temperature for fusion.

Next, fusion is performed during an interval from the point of time t2 at which the temperature of the heating roller 132 reaches the target temperature, and thus the interval is referred to as a fusion performing interval. During the fusion performing interval, the heating roller 132 is controlled to maintain its temperature within a desirable range around the target temperature. In other words, during the fusion performing interval, the heating roller 132 is controlled to maintain its temperature at or near the target temperature. Here, the phase of the AC voltage V1 is controlled to maintain the temperature of the heating roller 132 within a desirable range around the target temperature during the fusion performing interval and the fusing voltage V2 is output. FIG. 4 shows that the fusing voltage V2 is output by controlling the phase of the AC voltage V1 via the PWM of the control signal CS during the interval from the point of time t2. That is, from t2 through tn, the fusing voltage V2 is output by controlling the phase of the AC voltage V1 according to the control signal CS, in order to maintain the temperature of the heating roller 132 within a desirable range around the target temperature. Referring to the circuit diagram of FIG. 3, since the control unit 160 applies a control signal, to which the PWM is performed, to the triac T of the fusion driving circuit 140, the fusing voltage V2 generated by controlling the phase of the AC voltage V1 is a voltage supplied by the external AC power unit 10 and adjusted according to the control signal to be supplied to the heat generating member 133, and thus the heating roller 132 maintains the target temperature.

Referring to FIG. 4, only the controlling of the number of waveforms is performed during the warm-up interval from the point of time t1 to the point of time t2 and the fusing voltage V2 identical to the AC voltage V1 is output to the fusion unit 130 without controlling the phase of the AC voltage V1. However, FIG. 5 shows an embodiment in which the fusing voltage V2 generated by controlling the phase of the AC power V1 via PWM of the control signal (CS) is output even during a warm-up interval from the point of time t1 to a point of time t3. In more detail, the warm-up interval is from the point of time t1, at which the temperature of the heating member 132 starts to rise, to the point of time t3, at which the temperature of the heating member 132 reaches the target temperature. During the interval from the point of time t1 to the point of time t2, a number of waveforms of the AC power V1 is controlled and the AC voltage V1 is output as the fusing voltage V2, and during the interval from the point of time t2 to the point of time t3, the fusing voltage V2 generated by controlling the phase of the AC power V1 is supplied. The reason for controlling the phase during the warm-up interval is to prevent the flicker due to overpower. If the initial resistance of the heat generating member 133 is set small to reduce a warm-up time, resistance of the heat generating member 133 decreases as the temperature of the heat generating member 133 increases, and thus the flicker may occur due to overpower. Therefore, the temperature of the heating roller 132 may be increased to the target temperature more stably, where the point of time t2 at which the phase control begins may be arbitrarily set according to environments. For example, the point of time t2 may be a point of time at which the temperature of the heating roller 132 reaches a temperature from about 50% to about 90% of the target temperature. Further, according to the embodiment illustrated in FIG. 5, from t3 through tn, the fusing voltage V2 is output by controlling the phase of the AC voltage V1 according to the control signal CS, in order to maintain the temperature of the heating roller 132 within a desirable range around the target temperature.

FIGS. 6 through 9 are flowcharts for illustrating methods of controlling a fusing temperature of an image forming apparatus according to embodiments of the present general inventive concept. Hereinafter, methods of controlling the fusing temperature of an image forming apparatus according to embodiments of the present general inventive concept will be described in detail with reference to FIGS. 6 through 9.

Figure 6:
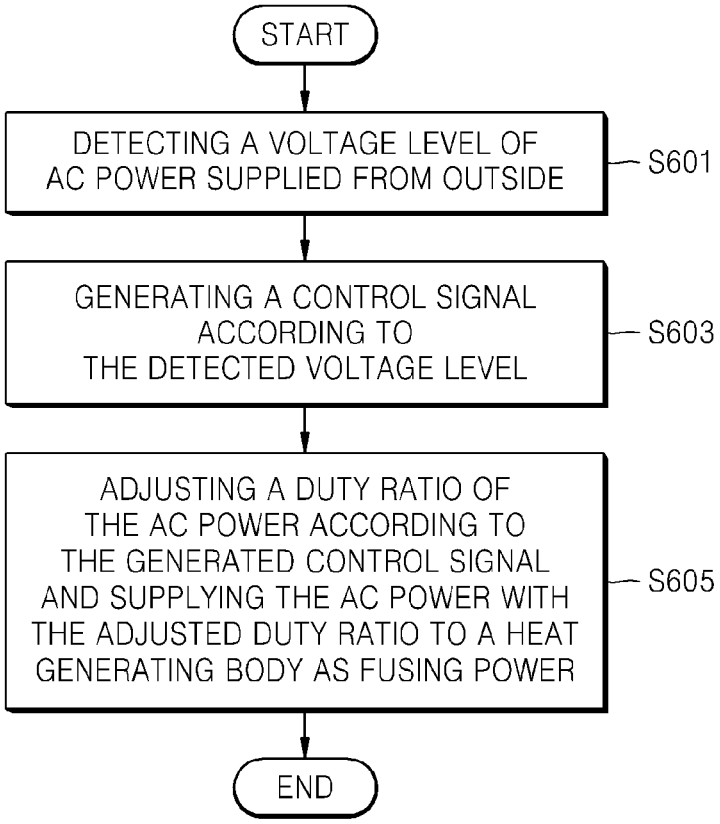
FIGS. 6 through 9 are flowcharts for illustrating methods of controlling a fusing temperature of an image forming apparatus according to embodiments of the present general inventive concept.

Referring to FIG. 6, a voltage level of AC power supplied from outside of an image forming apparatus is detected in operation S601, and a control signal is generated according to the detected voltage level in operation S603. Next, in operation S605, a duty ratio of the AC power is adjusted according to the generated control signal and the AC power with the adjusted duty ratio is supplied to a heat generating body as fusing power. As described above, an image forming apparatus may be embodied by controlling supply of fusing power according to the voltage level of the AC power supplied from outside. Furthermore, since the image forming apparatus according to the embodiment as described above includes the heat generating member 133 having an NTC characteristic, the image forming apparatus may include only one heat generating body to have two or more different rated voltages by controlling the fusing power and may also suppress the inrush current and the flicker.

Figure 7:
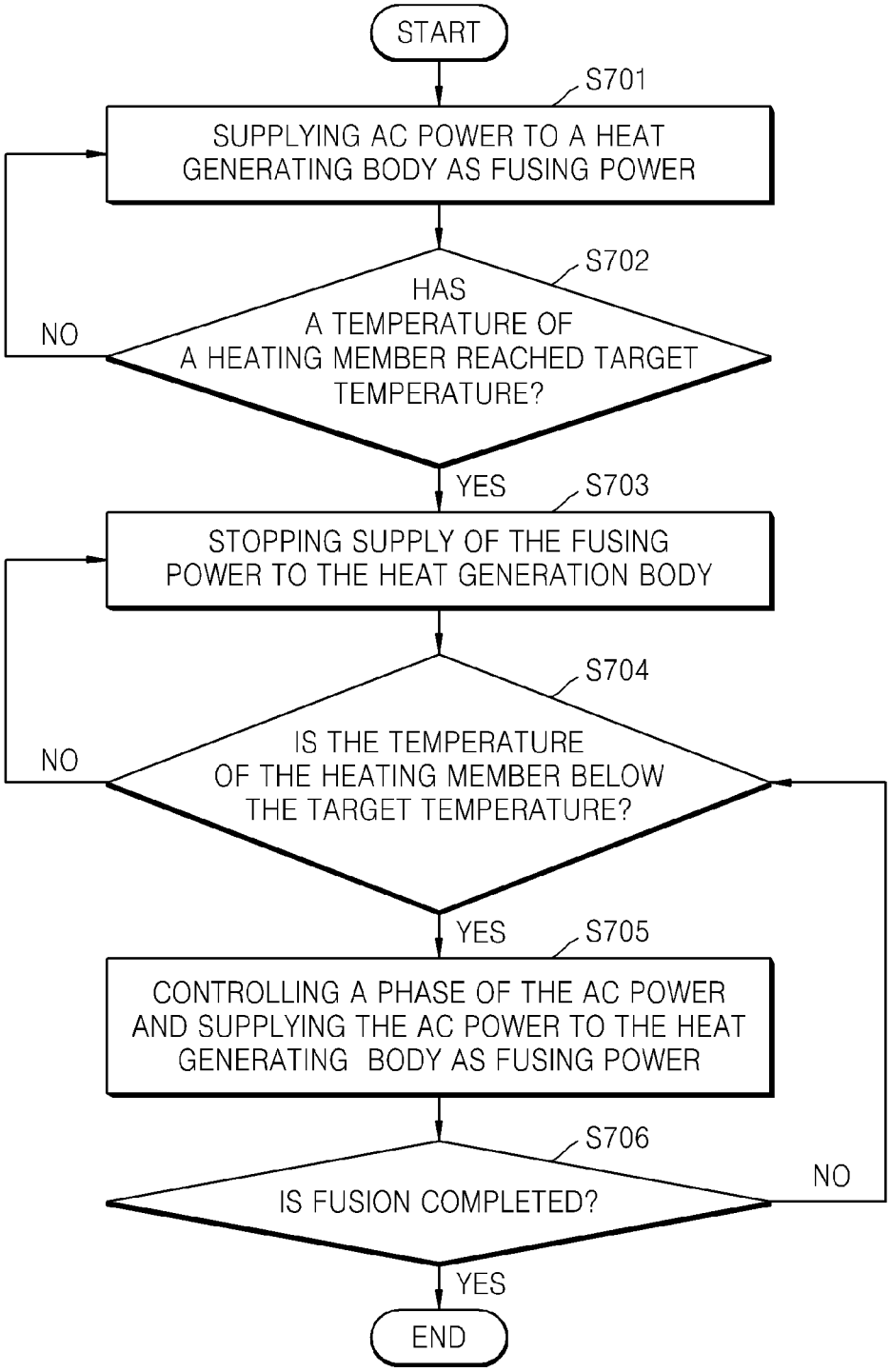
Figure 8:
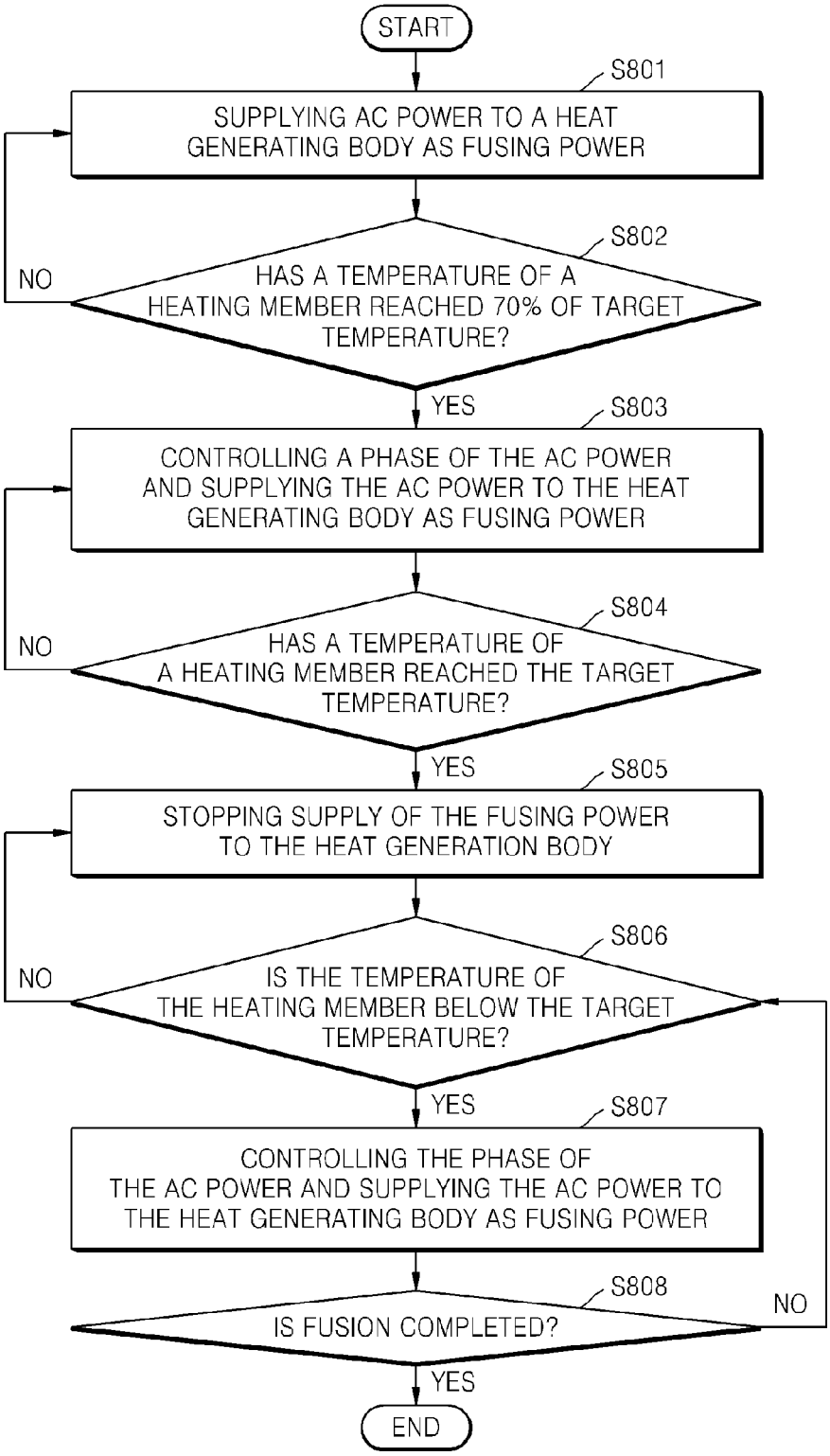

Operation S605 of FIG. 6 is shown in more detail in flowcharts in FIGS. 7 and 8. Furthermore, the methods of controlling the fusing temperature, as shown in FIGS. 7 and 8, correspond to FIGS. 4 and 5, respectively.

Referring to FIG. 7, the controlling of the number of waveforms is performed with respect to the AC power supplied from outside and the controlled AC power is supplied to a heat generating body (e.g., the heat generating member 133) as fusing power to start a warm-up interval (operation S701). After a predetermined period of time, it is determined whether a temperature of a heating member (e.g., the heating roller 132) that is heated by heat generated by the heat generating body has reached a target temperature required for performing fusion (operation S702). If it is determined that the temperature of the heating member has reached the target temperature, the method proceeds to operation S703 in which supplying of the fusing power to the heat generating body is stopped. If it is determined that the temperature of a heating member has not reached the target temperature, the method returns to operation S701. Meanwhile, when a predetermined period of time is elapsed after the supplying of the fusing power is stopped, it is determined whether the temperature of the heating member is below the target temperature (operation S704). If it is determined that the temperature of the heating member is below the target temperature, the phase of the AC power is controlled in operation S705 and the AC power is supplied to the heat generating body as fusing power. In operation S706, it is determined whether fusion is completed. If it is determined that the fusion is completed, the method is completed. If it is determined that the fusion is not completed, the method returns to operation S704. Accordingly, the heating member may be controlled to maintain the target temperature.

Referring to FIG. 8, the controlling of the number of waveforms is performed with respect to the AC power supplied from outside and the controlled AC power is supplied to a heat generating body (e.g., the heat generating member 133) as fusing power to start a warm-up interval (operation S801). Compared to the method of controlling the fusing temperature shown in FIG. 7, the method of controlling the fusing temperature shown in FIG. 8 further includes operations S802 and S803. If the temperature of a heating member (e.g., the heating roller 132) reaches 70% of the target temperature (operation S802), the phase of the AC power is controlled and the controlled AC power is supplied to the heat generating body as the fusing power (operation S803). Otherwise, the method returns to operation S801, as illustrated in FIG. 8. In other words, although the method of FIG. 7 supplies the controlled AC power as the fusing power until the end of the warm-up interval in operation S702 in, in operation S803 shown in FIG. 8, if the temperature of a heating member reaches 70% of the target temperature, the phase of the AC power is controlled and the controlled AC power is supplied as fusing power even before the end of the warm-up interval. Although the phase of the AC power is controlled and the AC power is supplied as the fusing power from a point of time at which the temperature of the heating member reaches 70% of the target temperature in this embodiment, the temperature of the heating member at which the phase of the AC power is controlled and the AC power is supplied may be set differently depending on situations and may be any temperature as long as the temperature is below the target temperature. Then, it is determined whether the temperature of the heating member has reached the target temperature (operation S804). If it is determined that the temperature of the heating member has reached the target temperature, supplying of the fusing power to the heat generating body is stopped (S805). Otherwise, the method returns to operation S803. Operations S805-S808 of FIG. 8 are performed in the same manner as operations S703-S706 of FIG. 7. As described above and as illustrated in FIG. 8, even during the warm-up interval, the phase of the AC power may be controlled and the AC power may be supplied as fusing power after a predetermined point of time. As a result, even if the initial resistance of a heat generating body is small, the flicker due to overpower supplied to the heat generating body may be prevented.

Figure 9:
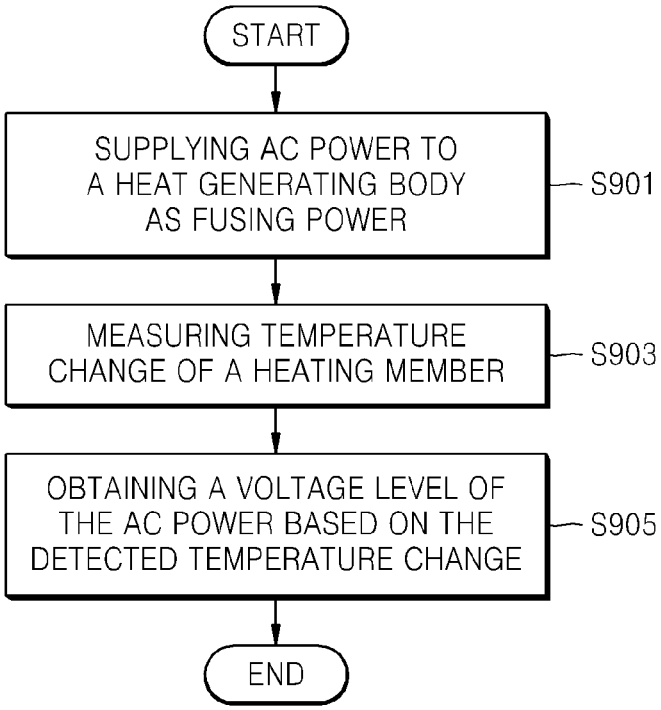

FIG. 9 is a flowchart showing operation S601 of FIG. 6 in detail. In other words, the flowchart shown in FIG. 9 shows a method of detecting a voltage level of AC power supplied from outside based on a temperature change of a heating member during a warm-up interval. In more detail, the AC power supplied from outside is supplied to a heat generating body as fusing power in operation S901, and the temperature change of the heating member is measured in operation S903. Since the AC power supplied from outside is supplied to the heat generating body without phase control, the temperature change measured in operation S903 is proportional to the voltage level of the AC power. Therefore, in operation S905, the voltage level of the AC power may be obtained based on the detected temperature change. For example, the voltage level of the AC power may be obtained by using a look-up table in which voltage levels corresponding to temperature changes are recorded in advance.

Although the voltage level of the AC power may be obtained based on the temperature change of the heating member as shown in FIG. 9, the voltage level of the AC power may also be obtained by arranging a potential transformer or a photo coupler in a fusion driving circuit which receives the AC power and supplies fusing power.

Figure 10:
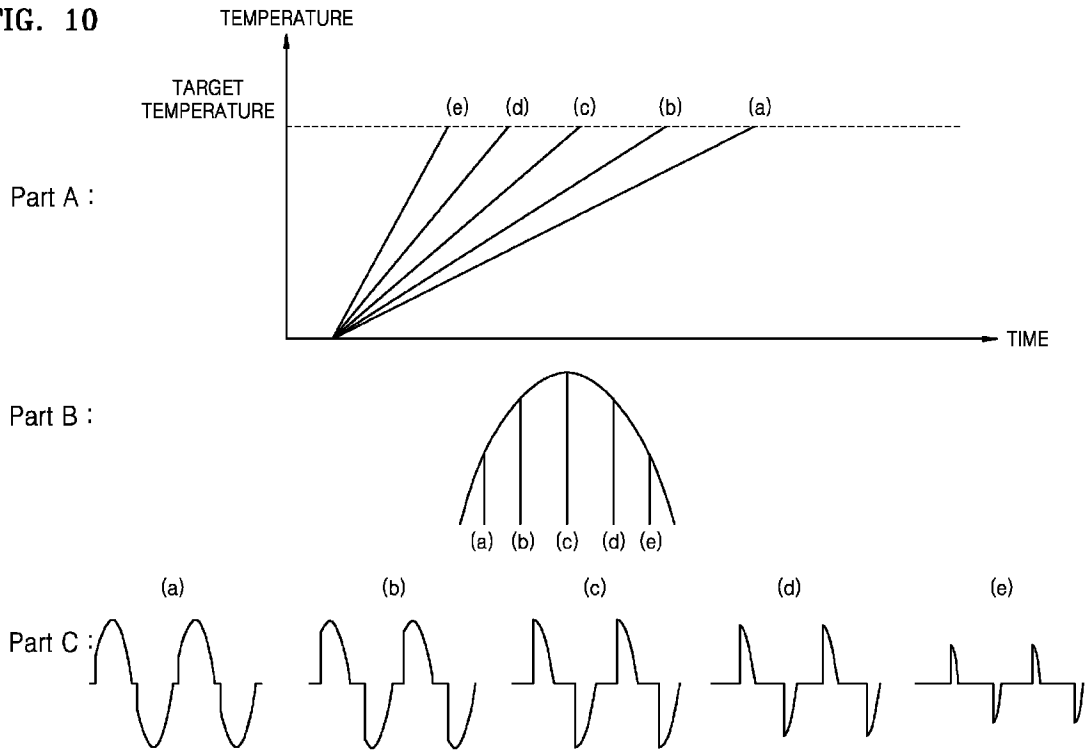
FIG. 10 is a graph for illustrating how to set a firing angle for phase control based on a voltage level of AC power detected by measuring a temperature change.

FIG. 10 is a graph for illustrating how to set a firing angle for phase control based on a voltage level of AC power detected by measuring a temperature change. The straight lines (a) through (e) in Part A (the upper graph) shown in FIG. 10 indicate temperature changes of a heating member as time elapses in correspondence to AC powers with different voltage levels. The higher the voltage level of the supplied AC power is, the faster the temperature of the heating member rises. Therefore, it is clear that voltage levels of the AC powers increase from (a) to (e). If voltage level of AC power is high, a curve indicating temperature change of a heating member may be rippled, and thus it is necessary to set a sufficiently large firing angle to reduce fusing power. Referring to FIG. 10, since voltage levels of the AC power increase from (a) to (e), a curve indicating a temperature change of a heating member may be prevented from rippling by increasing firing angles from (a) to (e) for phase control. That is, the firing angle for (a) is the smallest and the firing angle for (e) is the largest. Thus, the proportion of the AC power that is reduced is the smallest for (e) and the largest for (a). Part B illustrates the (a) to (e) corresponding to four firing angles, over a half cycle of the AC power, and Part C illustrates the fusing power for (a) through (e).

As described above, since a fuser uses a single heat generating body having an NTC characteristic for heating a heating member, manufacturing costs, size, and weight of an image forming apparatus including the fuser may be reduced. Furthermore, inrush current and flicker may be suppressed when various voltages are input as fusing powers.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An image forming apparatus having two or more different rated voltages, the image forming apparatus comprising:

a voltage detecting unit, which detects a voltage level of alternating current (AC) power supplied from outside of the image forming apparatus;

a control unit, which outputs a control signal according to the detected voltage level;

a fusion driving circuit, which controls a number of waveforms and a phase of the AC power according to the control signal and outputs the controlled AC power as fusing power; and a fuser including:

a heat generating body having a negative temperature coefficient (NTC) characteristic, which receives the fusing power and generates resistance heat; and a heating member, which is heated by the resistance heat generated by the heat generating body and fuses an image formed on a printing medium, wherein the control unit outputs the control signal, such that the fusion driving circuit controls the number of waveforms of the AC power and outputs the controlled AC power as the fusing power during a warm-up interval until the temperature of the heating member reaches a target temperature before the fusing is performed, and controls the phase of the AC power and outputs the controlled AC power as the fusing power during a fusing performing interval after the temperature of the heating member has reached the target temperature.

2. The image forming apparatus of claim 1, further comprising a temperature measuring unit, which measures a temperature of the heating member, wherein the control unit outputs the control signal, such that the temperature of the heating member measured by the temperature measuring unit reaches the target temperature to perform the fusing.

3. The image forming apparatus of claim 2, wherein the control unit outputs the control signal, such that the fusion driving circuit controls the number of waveforms of the AC power and outputs the controlled AC power as the fusing power during a warm-up interval until the temperature of the heating member reaches a predetermined temperature below the target temperature before the fusing is performed, and controls the phase of the AC power and outputs the controlled AC power as the fusing power during a fusing performing interval after the temperature of the heating member has reached the predetermined temperature below the target temperature.

4. The image forming apparatus of claim 2, wherein the voltage detecting unit detects the voltage level of the AC power based on a temperature change of the heating member during the warm-up interval until the temperature of the heating member reaches the target temperature to perform fusion.

5. The image forming apparatus of claim 1, wherein the control unit outputs the control signal, such that the fusion driving circuit controls the phase of the AC power by changing a firing angle according to the detected voltage level and outputs the controlled AC power as the fusing power.

6. The image forming apparatus of claim 1, wherein the heat generating body is a carbon heat generating body or a carbon nanotube heat generating body.

7. The image forming apparatus of claim 1, wherein the control unit outputs a pulse width modulation (PWM) control signal according to the detected voltage level.

8. The image forming apparatus of claim 1, wherein during the warm-up interval the controlled AC power is identical to the fusing power, and the fusion driving circuit controls the number of waveforms of the AC power without controlling the phase of the AC power.

9. The image forming apparatus of claim 1, wherein during the warm-up interval the controlled AC power is identical to the fusing power for a first sub-interval of the warm-up interval, and the controlled AC power is different from the fusing power for a second sub-interval of the warm-up interval.

10. A method of controlling a fusing temperature of an image forming apparatus having two or more different rated voltages, the image forming apparatus comprising a fuser including a heat generating body having a negative temperature coefficient (NTC) characteristic, which receives the fusing power and generates resistance heat, and a heating member, which is heated by the heat generated by the heat generating body and fuses an image formed on a printing medium, the method comprising:

detecting a voltage level of alternating current (AC) power supplied from outside;

controlling the number of waveforms and phase of the AC power according to the detected voltage level, such that the heating member maintains a target temperature to perform the fusing and supplying the controlled AC power to the heat generating body as fusing power, wherein the controlling and supplying of the AC power comprises:

controlling the number of waveforms of the AC power and supplying the controlled AC power to the heat generating body as the fusing power during a warm-up interval until the temperature of the heating member reaches a predetermined temperature below the target temperature before the fusing is performed; and controlling the phase of the AC power and outputting the controlled AC power as the fusing power during a fusing performing interval after the temperature of the heating member has reached the predetermined temperature below the target temperature.

11. The method of claim 10, wherein the controlling and supplying of the AC power comprises:

controlling the number of waveforms of the AC power and supplying the controlled AC power to the heat generating body as the fusing power during a warm-up interval until the temperature of the heating member reaches the target temperature before the fusing is performed; and controlling the phase of the AC power and outputting the controlled AC power as the fusing power during a fusing performing interval after the temperature of the heating member has reached the target temperature.

12. The method of claim 10, wherein, in the controlling and supplying of the AC power, the phase of the AC power is controlled by changing a firing angle according to the voltage level of the AC power and the controlled AC power is supplied to the heat generating body as the fusing power.

13. The method of claim 10, wherein, in the detecting of the voltage level of the AC power, the voltage level of the AC power is detected based on a temperature change of the heating member during a warm-up interval until the temperature of the heating member reaches the target temperature to perform fusing.

14. A computer readable recording medium having recorded thereon a computer program for implementing the method of claim 10.

15. An image forming apparatus comprising:

a control unit to output a control signal according to a detected voltage level of alternating current (AC) power;

a fusion driving circuit to adjust the AC power according to the control signal and to output the adjusted AC power as fusing power, the AC power is adjusted by controlling a number of waveforms and a phase of the AC power according to the control signal; and a fuser including:

a heat generating body having a negative temperature coefficient (NTC) characteristic, the heat generating body to receive the fusing power to generate resistance heat; and a heating member that is heated by the resistance heat to fuse an image formed on a printing medium, wherein the control unit outputs the control signal, such that the fusion driving circuit controls the number of waveforms of the AC power and outputs the controlled AC power as the fusing power during a warm-up interval until the temperature of the heating member reaches a target temperature before the fusing is performed, and controls the phase of the AC power and outputs the controlled AC power as the fusing power during a fusing performing interval after the temperature of the heating member has reached the target temperature.

16. The image forming apparatus of claim 15, wherein the control unit outputs the control signal according to a temperature of the heating member.

17. The image forming apparatus of claim 16, wherein the control unit outputs the control signal for the adjusted AC power to heat the heating member until the temperature of the heating member reaches the target temperature to perform fusing.

18. The image forming apparatus of claim 16, wherein the control unit outputs a first control signal to heat the heating member until the temperature of the heating member reaches a middle temperature below the target temperature to perform fusing, and then outputs a second control signal to heat the heating member until the temperature of the heating member reaches the target temperature to perform fusing.

19. The image forming apparatus of claim 16, wherein the control unit outputs the control signal to stop heating the heating member if the control unit determines that the temperature of the heating member has reached the target temperature to perform fusing.

20. The image forming apparatus of claim 15, further comprising:

a voltage detecting unit to detect the voltage level of the AC power to provide the detected voltage level to the control unit.

21. The image forming apparatus of claim 20, wherein the voltage detecting unit detects the voltage level of the AC power based on a temperature change of the heating member until the temperature of the heating member reaches a target temperature to perform fusion.

22. The image forming apparatus of claim 21, wherein the voltage level of the AC power is obtained by using a look-up table that includes voltage levels corresponding to respective temperature changes.

23. The image forming apparatus of claim 15, further comprising:

a temperature measuring unit to measure a temperature of the heating member, wherein the control signal output by the control unit is based on the measured temperature of the heating member.

24. The image forming apparatus of claim 15, wherein the control unit outputs the control signal based on a firing angle according to the detected voltage level to control the phase of the AC power according to the control signal.

* * * * *